US005242366A

United States Patent [19]

Kita

[11] Patent Number: 5,242,366

[45] Date of Patent: Sep. 7, 1993

[54] MECHANISM FOR FOLDING CONTINUOUS-FORM SHEET

[75] Inventor: Masahiro Kita, Tokyo, Japan

[73] Assignee: Asahi Kogaku Kogyo Kabushiki Kaisha, Tokyo, Japan

[21] Appl. No.: 811,929

[22] Filed: Dec. 23, 1991

Related U.S. Application Data

[63] Continuation of Ser. No. 548,815, Jul. 6, 1990, abandoned.

[30] Foreign Application Priority Data

Jul. 7, 1989 [JP] Japan ..... 1-80411[U]

[51] Int. Cl.[5] ..... B31B 1/88; B31F 1/08; A63D 5/00

[52] U.S. Cl. ..... 493/320; 493/410; 493/425; 493/454; 270/39

[58] Field of Search ..... 270/39, 30, 31, 52.5; 493/410–415, 320, 425, 454

[56] References Cited

U.S. PATENT DOCUMENTS

| | | | |
|---|---|---|---|
| 3,190,639 | 6/1955 | Johnson | 493/410 |
| 3,912,252 | 10/1975 | Stephens | 493/414 |
| 4,045,012 | 8/1977 | Jakob | 493/415 |
| 4,054,235 | 10/1977 | Witcher | 493/410 |
| 4,210,318 | 7/1980 | Ver Mehren | 493/454 |
| 4,332,581 | 6/1982 | Thompson | 493/410 X |
| 4,388,072 | 6/1983 | Mueller et al. | 493/410 |
| 4,547,184 | 10/1985 | Bunch, Jr. | 493/414 |
| 4,813,357 | 3/1989 | Ward | 270/39 |
| 4,846,454 | 7/1989 | Parkander | 270/39 |
| 5,064,179 | 11/1991 | Martin | 270/52.5 X |
| 5,074,836 | 12/1991 | Fechner et al. | 493/411 |
| 5,080,644 | 1/1992 | Bunch, Jr. | 493/411 |

FOREIGN PATENT DOCUMENTS

| | | | |
|---|---|---|---|
| 283088 | 9/1988 | European Pat. Off. | 270/39 |
| 1680807 | 5/1954 | Fed. Rep. of Germany . | |
| 356681 | 5/1980 | Fed. Rep. of Germany . | |
| 2258338 | 8/1975 | France . | |
| 55-031758 | 3/1980 | Japan . | |
| 56-28162 | 3/1981 | Japan . | |
| 131669 | 8/1982 | Japan | 270/31 |
| 236974 | 11/1985 | Japan | 270/31 |
| 282262 | 12/1986 | Japan | 270/39 |
| 56259 | 3/1987 | Japan | 270/31 |
| 197282 | 8/1989 | Japan | 270/31 |
| 1367062 | 9/1974 | United Kingdom . | |

OTHER PUBLICATIONS

English Language Abstract of Japanese Patent 55-31758.

English Language Translation of German Office Action dated Sep. 11, 1992.

*Primary Examiner*—Edward K. Look
*Assistant Examiner*—John Ryznic
*Attorney, Agent, or Firm*—Sandler, Greenblum & Bernstein

[57] ABSTRACT

An imaging device is provided utilizing a continuous-form recording sheet (i.e., continuous-form sheeting), having a plurality of transverse perforations at predetermined intervals of length, on which the desired image is formed. At least an oscillating member which is driven by a rotating shaft is provided for oscillating continuous-form sheeting discharged from the imaging device. The oscillation caused by the oscillating member forwardly propagates the sheeting toward the imaging device. The continuous-form sheet is alternately and accurately folded at the transverse perforations in opposite directions, and stacked in a vertical direction between two folding positions as the continuous-form sheeting is discharged from the imaging device.

51 Claims, 4 Drawing Sheets

MECHANISM FOR FOLDING CONTINUOUS-FORM SHEET

This application is a continuation of application Ser. No. 07/548,815, filed Jul. 6, 1990, now abandoned.

BACKGROUND OF THE INVENTION

This invention relates to a mechanism for folding continuous-form sheeting, which is provided with perforations at predetermined intervals so that a part may be torn off easily. The sheeting is supplied in such a state that the sheets of the continuous-form sheeting have been stacked up by alternately folding them at the perforations, in such a way that the sheets of the continuous-form sheet may be stacked up by folding them at the perforations after the formation of images thereon in the same manner as before the formation of the images.

Heretofore, continuous-form sheeting known as fan-folded sheeting has been employed in printers for printing, and particularly for outputs from computers. Such continuous-form sheeting is provided with perforations at predetermined intervals so that a part may be torn off easily and is supplied in such a state that sheets of the continuous-form sheeting have been stacked up by alternately folding them at the perforations.

The use of such continuous-form sheeting (for printing) affords numerous merits including: having output data checked in the order in which the data is output, facilitating proper arrangement of data as it is output continuously, making it possible to supply many sheets of forms without using a stacker, and simplifying sheet feed control, i.e., type position control, with accuracy by means of driving sprocket holes. Each of the sheets of the continuous-form sheeting after being used for printing, are stacked in line with their creases or perforations as before printing.

There have recently been developed imaging apparatus such as laser beam printers, the use of which is expanding steadily, for obtaining hard copies by utilizing electrophotography in a manner similar to electronic copying machines. In such machines, scanning the surface of a photoconductive drum is scanned and charged with a laser beam modulated according to data pertaining to images, such as graphic forms, characters and the like. The surface of the photoconductive drum is exposed to light, and the images are formed on recording sheeting.

Such a laser beam printer has been substantially patterned after the existing electronic copying machine, where a sheet cut in predetermined size, is used as the recording sheet. For a fixing device, a pair of fixing heat rollers are formed by disposing a backup roll in pressure-contact with a heat roller which is heated to a high temperature. In other words, the process generally adopted is a so-called fixation by means of a heat roller, in which recording sheeting carrying an unfixed toner image is passed between the rollers to fix the toner to the sheeting by fusion-bonding. In this case, there is an increased demand for the use of continuous-form sheeting.

When continuous-form sheeting is employed in an imaging apparatus in which the fixing method by means of a heat roller is employed, the perforated creases where sheets are folded tend to become undone, because the continuous-form sheeting heated and pressed, i.e., heat-pressed in the fixing unit of the imaging apparatus. Thus, the continuous-form sheeting is not thereafter easily folded.

The arrangement stated above is therefore disadvantageous in that the continuous-form sheeting discharged from the imaging apparatus is left unfolded or irregularly bent, thus causing disorder in the vicinity of the sheet discharge port as the sheeting is irregularly bent.

Even in the case of conventional printers such as wire dot printers and the like, difficulties arise in the folding and stacking of continuous-form sheeting after printing operations. For this reason, there has been contrived a means for guiding the sheet in a direction along which it is discharged in accordance with the bending direction thereof by providing a rocking guide arm, moving a stacker table back and forth in accordance with the bending direction of the sheeting or the like. However, these means proposed or implemented are invariably complicated in construction and not capable of effectively folding sheeting that has been heat-pressed during heat-roll fixation.

SUMMARY OF THE INVENTION

It is therefore an object of the present invention to provide an improved folding mechanism for accurately folding continuous-form sheeting with a simple construction even if the continuous-form sheeting has been heat-pressed during heat roll fixation.

For this purpose, according to the invention, there is provided a sheet folding mechanism for an imaging device which employs continuous-form sheeting having a plurality of transverse perforations at predetermined intervals of length along a longitudinal direction of said continuous-form sheeting. The mechanism includes an oscillating member for oscillating the continuous-form sheeting discharged from the imaging device, whereby the oscillation caused by the oscillating member is forwardly propagated and the continuous-form sheeting is alternatively folded at the transverse perforations in opposite directions and stacked in a vertical direction between two folding positions as the continuous-form sheeting is discharged from the imaging device.

With this arrangement, the continuous-form sheeting after image formation is moved up and down by means of the oscillating member and the oscillation is forwardly propagated. Consequently, the folding of the continuous-form sheeting at the perforations is accelerated because of the oscillation. The continuous-form sheeting is thus folded as neatly as it was before the image formation.

DESCRIPTION OF THE ACCOMPANYING DRAWINGS

FIGS. 1A through 1C are schematic structural side views of the mechanism according to the invention for folding the foldable continuous-form sheeting; and FIGS. 2 through 5 are respective schematic structural side views of other mechanisms embodying the present invention.

DESCRIPTION OF THE EMBODIMENTS

A description is given of an embodiment of the present invention with reference to the accompanying drawings.

Figure 1B:
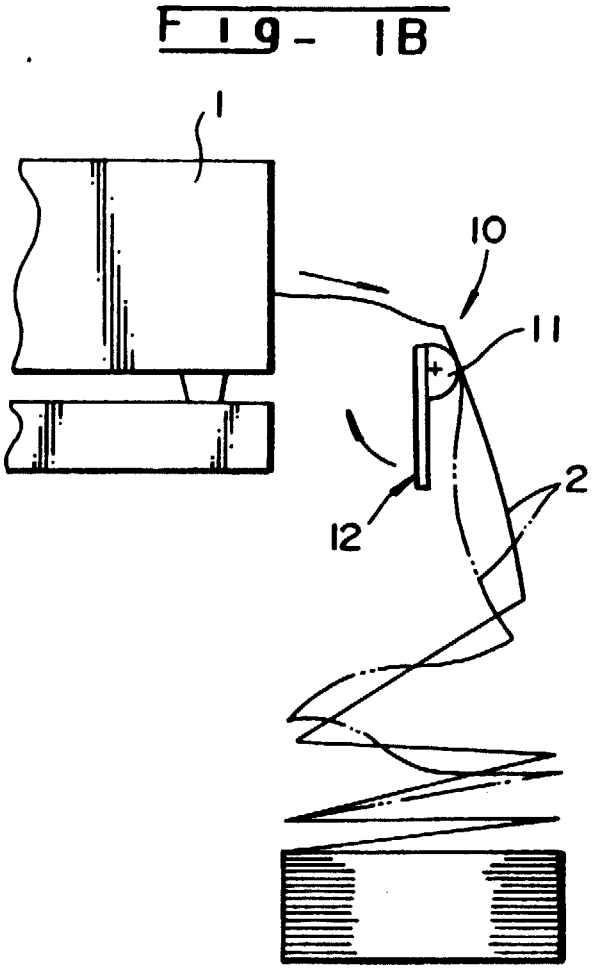
Figure 1A:
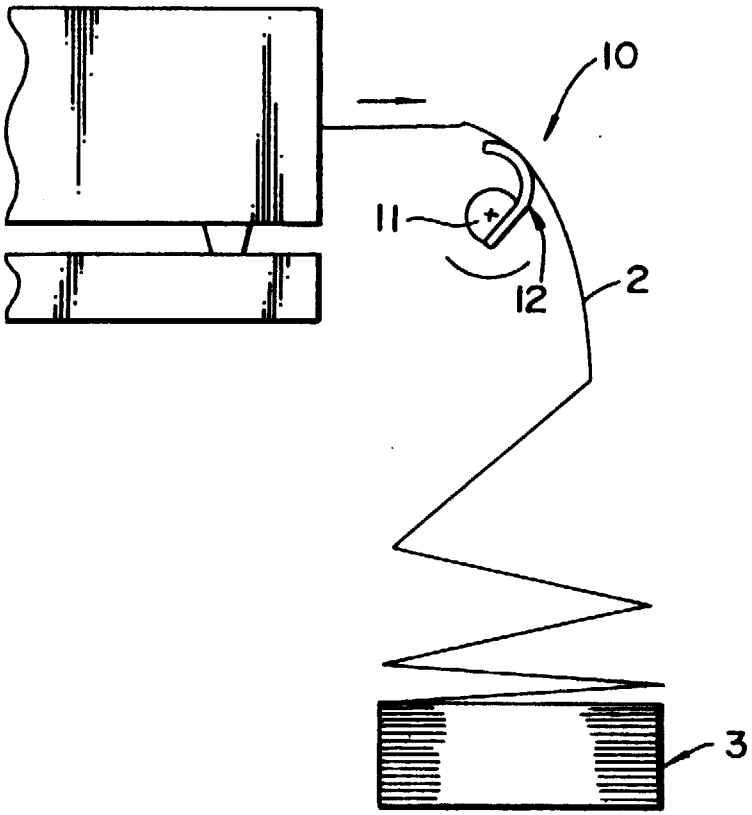

FIGS. 1A and 1B show a mechanism for folding continuous-form sheeting according to the present invention in such a manner that sheets of continuous-form sheeting 2 being discharged while carrying the images formed by a laser beam printer 1, are folded at perforations before being stacked in a stack section 3 positioned downward with respect to a direction along which the continuous-form sheeting 2 is discharged.

In this folding mechanism 10, a shaft 11, arranged to be driven to rotate, is provided in parallel to a width direction of the continuous-form sheeting 2. A beater 12 is fitted to the shaft 11 at a position substantially corresponding to the center of the continuous-form sheeting 2 in a width direction thereof. The shaft 11 and the beater 12 are arranged to be located under the continuous-form sheeting 2. The shaft 11 can be driven to rotate by a predetermined drive source provided on the laser beam printer for driving a predetermined component thereof, or the shaft 11 may be driven to rotate independently of any driven component of on the laser beam printer.

The beater 12 is formed of flexible plastic having predetermined thickness, -width and length. One end of beater 12 has been secured to the flatly cut portion of the shaft 11. It may be considered that the width of the beater 12 is arranged to have a predetermined dimension less than the width dimension of the continuous-form sheeting 2, and located at a position, as described above, corresponding to the center of the continuous-form sheeting 2 in the width direction thereof.

Figure 1C:
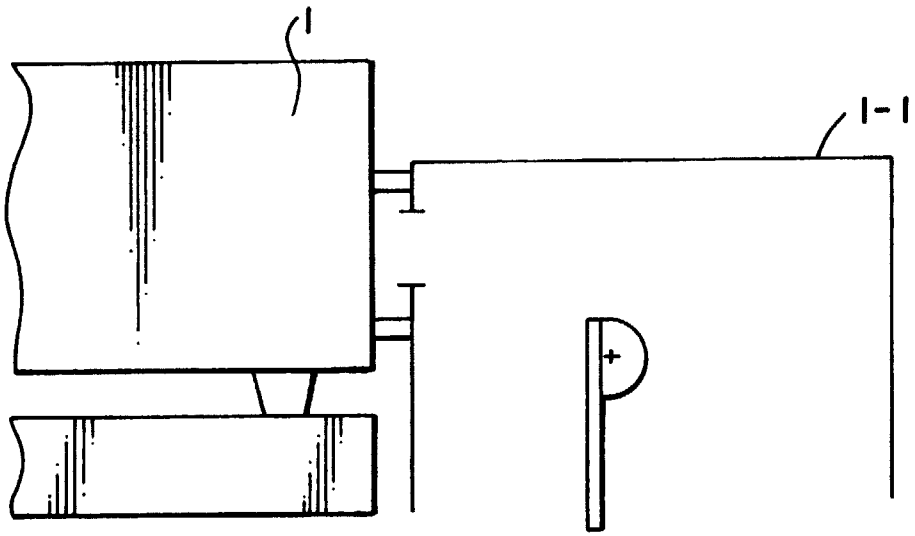

Furthermore, it may be considered that, as shown in FIG. 1C, the shaft 11 and the beater 12 are mounted on a predetermined housing member 1-1 arranged to be attachable to and detachable from the laser beam printer 1 by means of fixing members such as screws. The continuous-form sheeting 2 which is discharged from the laser beam printer 1 passes through the housing 1-1 and is stacked in the stack section 3.

The continuous-form sheeting 2 discharged from the laser beam printer 1 passes over the folding mechanism 10, including the shaft 11 and the beater 12, and is led down to the stack section 3 at which the continuous-form sheeting 2 is stacked.

With the arrangement described above, each of the sheets of the continuous-form sheeting 2 are alternately folded at the perforations in opposite directions and stacked in the stack section 3 in a vertical direction between two folding positions as follows.

While images are formed, the continuous-form sheeting 2 is pushed forward to reach the stack section 3 by skirting round the upper side of the shaft 11. At this time, the shaft 11 is driven to rotate in a clockwise direction, as shown by an arrow in the drawings of FIGS. 1A and 1B, in which the upper side thereof conforms to the direction along which the continuous-form sheeting 2 is discharged.

When the beater 12 is not positioned above the upper side of the shaft 11 (FIG. 1B, FIG. 2C) the continuous-form sheeting 2 directly contacts the shaft 11 as shown in FIG. 1B, and it is downwardly directed toward the stack section 3 along the circumferential surface of the shaft 11. When the beater 12 is positioned above the shaft 11 (FIG. 1A) as the shaft 11 rotates, the beater 12 primarily moves the continuous-form sheet 2 upwardly and it further bends because of its flexible property. Thus, the continuous-form sheet 2 is caused to mount on the beater 12, as shown in FIG. 1A. While rotating, the beater 12 raises the continuous-form sheeting 2 by moving beneath the continuous-form sheeting 2 and by hitting it from the underside as if flipping it with a finger.

As a result, the repeated movements of the continuous-form sheeting 2 in a vertical direction upon the rotations of the beater 12 are forwardly propagated from the hitting point by the beater 12, as shown by the imaginary (i.e., broken) line of FIG. 1B. The continuous-form sheeting 2 discharged from the laser beam printer 1 is accurately and easily folded at the perforations, (i.e.,) the portions at which the physical strength is arranged to be weaker than the other portions; even when it has been heat-pressurized, where it normally becomes difficult to accurately fold at the perforations.

When a beater 12 formed of a polyester sheet of the following dimensions is fitted to a shaft 11 and rotated at 120 r.p.m. (revolutions per minute) for testing purposes, continuous-form sheeting 2 can be folded satisfactorily to produce over 400 pages.

The dimensions are:

0.3 mm thick, 25 mm long, and 15 mm wide.

Of course, continuous-form sheeting is discharged from a laser beam printer 1 at a relatively slow pace as compared to the rate (120 r.p.m.) at which beater 12 rotates. Accordingly, beater 12 impacts the continuous-form sheeting 2 a plurality of times before reaching a next perforation at a next predetermined interval of length thereof. That is, the predetermined intervals of time at which the beater 12 hits continuous-form sheeting 2 are significantly smaller than the time that it takes for one sheet of the continuous-form sheeting to pass a fixed position.

A description will now be given of other embodiments of the present invention with reference to FIGS. 2 through 4.

Figure 2:
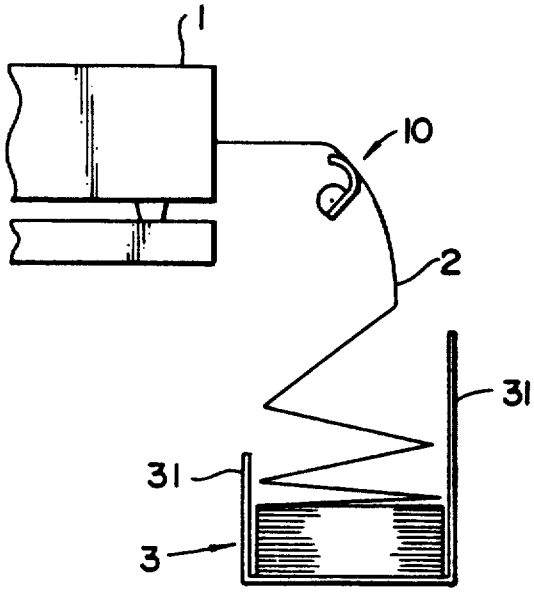

Referring to FIG. 2, a pair of guide plates 31, 31 are provided at the two folding positions of the stack section 3 into which the continuous-form sheeting 2 is discharged as in the first embodiment shown. The spacing between the pair of guide plates 31, 31 is selected to be slightly larger than the spacing of the perforations of the continuous-form sheeting 2 so that the continuous-form sheeting 2 is accurately stacked between the pair of guide plates 31, 31. It may be considered that one of the pair of guide plates 31, 31, positioned further from the hitting point, is constructed to be higher than the other, as shown in FIG. 2. With this structure, the discharged continuous-form sheeting 2 is contacted with the higher plate and prevented from exceeding the stack section 3.

With this arrangement, the folding operation of the continuous-form sheet 2 is forced because of contact resistance resulting from the contact of the perforations with the guide plates 31, 31 and each of the sheets of the continuous-form sheeting 2 are stacked neatly in the stack section 3. Moreover, the stacked sheets of the continuous-form sheeting 2 are prevented from inclining or collapsing. The number of pages to be stacked can thus be increased.

Figure 3:
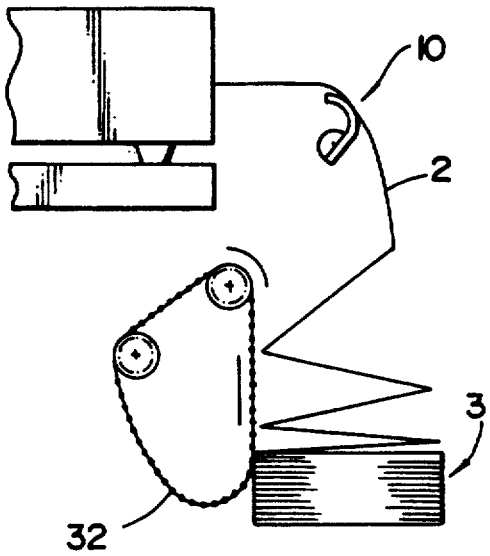
Figure 4:
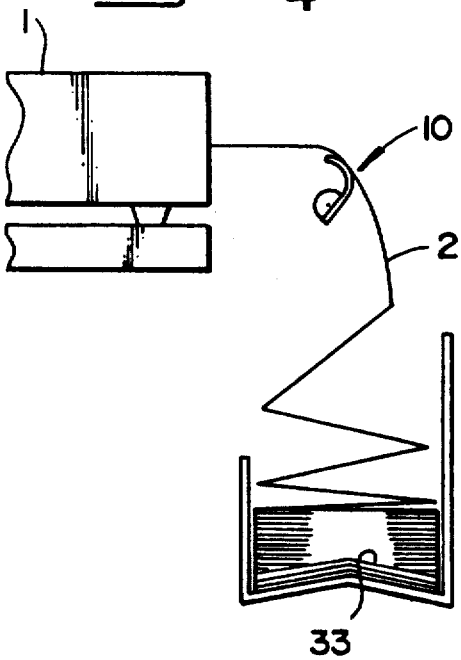

In FIG. 3, there is shown a chain 32, for forcing folding operation of continuous-form sheeting 2, which is arranged to come in contact with the folding portions, i.e., perforations, of the continuous-form sheeting as it enters the stack section 3. The chain 32 is drivable to revolve.

Figure 5:
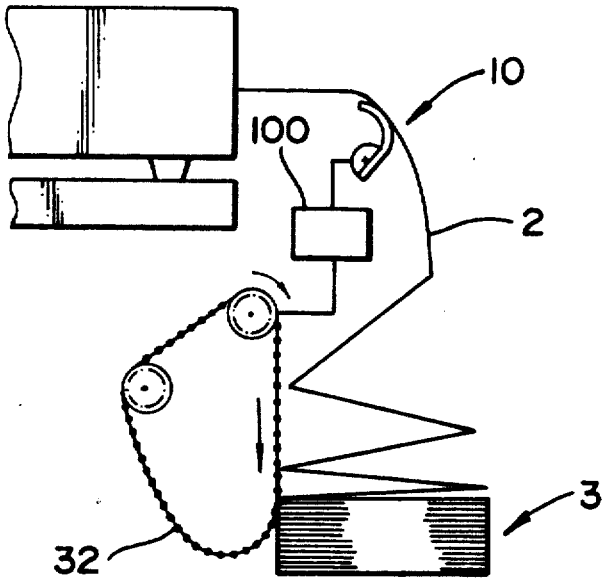

In this case, the chain 32 is driven to revolve in a direction in which a portion in contact with the bent portion of the continuous-form sheeting 2 moves downwardly, whereby the stacking of the continuous-form sheeting 2 is forced. Although the chain 32 has been disposed on one side of the stack section 3 near the direction of discharge of the continuous-form sheeting 2 in this embodiment, it may be disposed on the opposite side. The provision of such chains on both sides would be further effective. The chain 32 may be driven by the same drive source 100, for example, a motor, as is used for driving the shaft 11, as shown in FIG. 5. It may be considered that an endless belt arranged to have a predetermined mechanical resistance with the perforations is used instead of the chain 32.

Furthermore, it may be considered that the center portion of the bottom area of the stack section 3 in the width direction of the continuous-form sheeting 2 is slightly projected upwardly so that the two folding positions are forced down from the center position. For example, the projected portion can be formed as an inverted V-shaped bottom part 33, as shown in FIG. 4, having a predetermined dimension, for example, substantially equal to the width of the continuous-form sheeting 2, along the width direction of the continuous-form sheeting 2.

With this arrangement, the sheets of the continuous-form sheeting 2 are stacked up with the perforations forced down by the projected portion, whereby the number of stackable sheets can be increased.

As described above, the continuous-form sheeting after image formation is caused to be oscillated by an oscillation member such as the beater 12, and the wave motion of the continuous-form sheet 2 resulting from the oscillation is forwardly propagated toward the printer from the hitting point by the beater 12. Consequently, the continuous-form sheet, though it has been heat-pressurized, is accurately folded at the perforations. Each of the sheets of the continuous-form sheet are thus stacked up neatly after the image formation.

What is claimed is:

1. A sheet folding mechanism for an imaging device which employs and discharges, at an outlet side of said imaging device, continuous-form sheeting having a plurality of transverse perforations at predetermined intervals of length along a longitudinal direction of said continuous-form sheeting, said mechanism comprising beating means, provided near the outlet side of said imaging device, for flicking said continuous-form sheeting, while said continuous-form sheeting is in an unfolded state, at predetermined intervals of time after discharge from said imaging device, thereby causing a disturbance in the sheeting and initiating folding at said plurality of perforations, said continuous-form sheeting being alternately folded at said transverse perforations in opposite directions and stacked in a vertical direction between two folding positions as said continuous-form sheeting is discharged from said imaging device.

2. The sheet folding mechanism according to claim 1, wherein said beating means comprises a beater member provided at an outlet side of said imaging device for beating said continuous-form sheeting at predetermined intervals of time.

3. The sheet folding mechanism according to claim 2, wherein said beater member comprises a resilient member of a predetermined length made of a flexible material, which is secured to a shaft member provided in parallel to a width direction of said continuous-form sheeting, and arranged to be rotated at a speed related to said predetermined intervals of time.

4. The sheet folding mechanism according to claim 3, wherein said flexible material comprises plastic.

5. The sheet folding mechanism according to claim 3, wherein said beater member and said shaft member are provided below a portion of said continuous-form sheeting.

6. The sheet folding mechanism according to claim 1, further comprising a guiding member for guiding said continuous-form sheeting flicked by said beating means to be stacked in a vertical direction.

7. The sheet folding mechanism according to claim 6, wherein said guiding member comprises a pair of plate members provided opposite to each other at a predetermined dimension slightly larger than said predetermined intervals of length between said transverse perforations, whereby said continuous-form sheeting folded at said transverse perforations, is stacked between said plate members as said continuous-form sheeting is discharged from said imaging device.

8. The sheet folding mechanism according to claim 7, wherein one of said plate members positioned further from said imaging device is higher than the other of said plate members.

9. The sheet folding mechanism according to claim 1, further comprising a folding forcing mechanism for forcing the folding operation of said continuous-form sheeting flicked by said beating means.

10. The sheet folding mechanism according to claim 9, wherein said folding forcing mechanism comprises, chain member arranged to be rotated and which contacted with contacts at least one of said two folding positions of said continuous-form sheeting.

11. The sheet folding mechanism according to claim 1, wherein a center portion, extending in a width direction of said continuous-form sheeting, of a plane onto which said continuous-form sheeting is to be stacked, is slightly projected from said plane in a direction parallel to the direction of stacking.

12. The sheet folding mechanism according to claim 1, wherein said disturbance is propagated along a longitudinal direction of the continuous-form sheeting.

13. The sheet folding mechanism according to claim 12, wherein said disturbance is caused between adjacent perforations of the sheeting.

14. The sheet folding mechanism according to claim 1, wherein said beating means comprises a beating member, having a plurality of sides, one side of which is secured to a rotary shaft member provided parallel to a width direction of said continuous-form sheeting, and further wherein said beating member is arranged to be rotated about the axis of said shaft at a predetermined revolutional speed so as to work from one side of said continuous-form sheeting to another in a longitudinal direction, perpendicular to said width direction, in accordance with said predetermined intervals of time.

15. The sheet folding mechanism according to claim 1, wherein said beating means applies a short duration force of substantial impact to said continuous-form sheeting at predetermined intervals of time after said continuous-form sheeting is discharged from said imaging device.

16. The sheet folding mechanism according to claim 1, said beating means comprising a flexible member.

17. The sheet folding mechanism according to claim 1, wherein said beating means flicks said continuous-form sheeting, by hitting the said continuous-form sheeting with a member being moved at substantial velocity in a direction generally orthogonal to a generally planer surface of said continuous-form sheeting.

18. The sheet folding mechanism according to claim 1, wherein said beating means flicks said continuous-form sheeting a plurality of times before reaching a next perforation at a next predetermined interval of length.

19. The sheet folding mechanism according to claim 1, wherein said predetermined intervals of time are significantly smaller than the time that it takes for one predetermined interval of length of said continuous-form sheeting to pass a position which is fixed with respect to said sheet folding mechanism.

20. The sheet folding mechanism according to claim 1, wherein said beating means flicks said continuous-form sheeting substantially 120 times per minute.

21. The sheet folding mechanism according to claim 1, wherein said beating means comprises a beating member which rotates at least 360 degrees in one direction.

22. The sheet folding mechanism according to claim 1, said transverse perforations defining fold lines at which said web is to be folded, said mechanism further comprising means positioning said beating means adjacent said web and before said web is folded at said transverse perforations.

23. A sheet folding mechanism for an imaging device which employs continuous-form sheeting and forms an image on said continuous-form sheeting by a heat-pressing operation, said continuous-form sheeting having a plurality of transverse perforations at predetermined intervals of length along a longitudinal direction of said continuous-form sheeting, said sheet folding mechanism comprising:

means for flicking said continuous-form sheeting, while said continuous-form sheeting is in an unfolded state, at predetermined intervals of time after said continuous-form sheeting is discharged from said imaging device, thereby causing a disturbance in said continuous-form sheeting and initiating folding at said plurality of perforations; and guiding means for guiding said continuous-form sheeting which has been restored to a foldable condition by said flicking means to be stacked in a vertical direction, said sheeting being alternately folded at said transverse perforations in opposition directions and stacked along said guiding means in a vertical direction between two folding positions as said continuous-form sheeting is discharged from said imaging device.

24. The sheet folding mechanism according to claim 23, wherein said flicking means comprises a beater member provided at an outlet side of said imaging device.

25. The sheet folding mechanism according to claim 24, wherein said beater member comprises a resilient member of a predetermined length of a flexible material, which is secured to a shaft member provided in parallel to a width direction of said continuous-form sheeting, and arranged to be rotated at a speed related to said predetermined intervals of time.

26. The sheet folding mechanism according to claim 25, wherein said flexible material comprises plastic.

27. The sheet folding mechanism according to claim 25, wherein said beater member and said shaft member are provided below a portion of said continuous-form sheeting.

28. The sheet folding mechanism according to claim 23, wherein said guiding means comprises a pair of plate members positioned opposite to each other at a predetermined spaced dimension slightly larger than said predetermined intervals of length of said transverse perforations, whereby said continuous-form sheeting folded at said transverse perforations is stacked between said plate members as said continuous-form sheeting is discharged from said imaging device.

29. The sheet folding mechanism according to claim 28, wherein one of said plate members positioned further from said imaging device is higher than the other of said pole members.

30. The sheet folding mechanism according to claim 23, wherein the center portion, extending in a width direction of said continuous-form sheet, of a plane on which said continuous-form sheeting is to be stacked is slightly projected in a direction along which said continuous-form sheet is stacked.

31. The sheet folding mechanism according to claim 23, wherein said beating means comprises a beating member, having a plurality of sides, one side of which is secured to a rotary shaft member provided in parallel to a width direction of said continuous-form sheeting, and further wherein said beating member is arranged to be rotated about the axis of said shaft at a predetermined revolutional speed so as to work from one side of continuous-form sheeting to another in a longitudinal direction, perpendicular to said width direction, in accordance with said predetermined intervals of time.

32. A sheet folding mechanism for an imaging device which employs and discharges continuous-form sheeting having a plurality of transverse perforations at predetermined intervals of length along a longitudinal direction of said continuous-form sheeting, said sheet folding mechanism comprising:

beating means for flicking said continuous-form sheeting, while said continuous-form sheeting is in an unfolded state, at predetermined intervals of time after said continuous-form sheeting is discharged from said imaging device, thereby causing a disturbance in said continuous-form sheeting and initiating folding at said plurality of perforations; and guiding means for guiding said continuous-form sheeting restored to a foldable condition by said beating means to be stacked in a vertical direction, whereby said continuous-form sheeting is alternately folded at said transverse perforations in opposite directions and stacked along said guiding means in a vertical direction between two folding positions as said continuous-form sheeting is discharged from said imaging device.

33. The sheet folding mechanism according to claim 32, wherein a center portion, in a width direction of said continuous-form sheet, of a plane on which said continuous-form sheet is to be stacked, is slightly projected in a direction along which said continuous-form sheet is stacked.

34. The sheet folding mechanism according to claim 32, wherein said beating means comprises a beating member, having a plurality of sides, one side of which is secured to a rotary shaft member provided in parallel to a width direction of said continuous-form sheeting, and further wherein said beating member is arranged to be rotated about the axis of said shaft at a predetermined revolutional speed so as to work from one side of said continuous-form sheeting to another in a longitudinal direction, perpendicular to said width direction, in accordance with said predetermined intervals of time.

35. A sheet folding mechanism for an imaging device which employs and discharges continuous-form sheeting and forms an image on said continuous-form sheeting by a heat-pressing operation, said continuous-form sheeting having a plurality of transverse perforations at predetermined intervals of length along a longitudinal direction of said continuous-form sheeting, said sheet folding mechanism comprising:

beating means for flicking said continuous-form sheeting, while said continuous-form sheeting is in an unfolded state, at predetermined intervals of time after said continuous-form sheeting is discharged from said imaging device, thereby causing a disturbance in said continuous-form sheeting and initiating folding at said plurality of perforations; and folding forcing means for forcing the folding operation of said continuous-form sheeting which has been restored to a foldable condition by said beating means.

36. The sheet folding mechanism according to claim 35, wherein said beating means comprises a beater member provided at an outlet side of said imaging device.

37. The sheet folding mechanism according to claim 36, wherein said beater member comprises a resilient member of a predetermined length made of a flexible material, which is secured to a shaft member provided in parallel to a width direction of said continuous-form sheeting, and arranged to be rotated at a speed related to said predetermined intervals of time.

38. The sheet folding mechanism according to claim 37, wherein said flexible material comprises plastic.

39. The sheet folding mechanism according to claim 37, wherein said beater member and said shaft member are positioned below a portion of said continuous-form sheeting.

40. The sheet folding mechanism according to claim 35, wherein said folding forcing means comprises an endless chain member arranged to be rotated and contacted with at least one of said folding positions of said continuous-form sheet.

41. The sheet folding mechanism according to claim 40, wherein said beating means and said folding forcing means are drive by a same driving source.

42. The sheet folding mechanism according to claim 35, wherein said beating means comprises a beating member, having a plurality of sides, one side of which is secured to a rotary shaft member provided in parallel to a width direction of said continuous-form sheeting, and further wherein said beating member is arranged to be rotated about the axis of said shaft at a predetermined revolutional speed so as to work from one side of said continuous-form sheeting to another in a longitudinal direction, perpendicular to said width direction, in accordance with said predetermined intervals of time.

43. A sheet folding mechanism for an imaging device which employs and discharges continuous-form sheeting having a plurality of transverse perforations at predetermined intervals of length along a longitudinal direction of said continuous-form sheeting, said sheet folding mechanism comprising:

beating means for flicking said continuous-form sheeting, while said continuous-form sheeting is in an unfolded state, at predetermined intervals of time after said continuous-form sheeting is discharged from said imaging device, thereby causing a disturbance in said continuous-form sheeting and initiating folding at said plurality of perforations; and folding forcing means for forcing the folding operation of said continuous-form sheeting which has been restored to a foldable condition oscillated by said oscillating means.

44. The sheet folding mechanism according to claim 43, wherein said beating means and said folding forcing means are driven by a same driving source.

45. The sheet folding mechanism according to claim 43, wherein said beating means comprises a beater member positioned at an outlet side of said imaging device.

46. The sheet folding mechanism according to claim 45, wherein said beater member comprises a resilient member of a predetermined length made of a flexible material, which is secured to a shaft member provided in a parallel to a width direction of said continuous-form sheeting, and arranged to be rotated at a speed related to said predetermined intervals of time.

47. The sheet folding mechanism according to claim 46, wherein said beater member and said shaft member are positioned below a portion of said continuous-form sheeting.

48. The sheet folding mechanism according to claim 43, wherein said beating means comprises a beating member, having a plurality of sides, one side of which is secured to a rotary shaft member provided in parallel to a width direction of said continuous-form sheeting, and further wherein said beating member is arranged to be rotated about the axis of said shaft at a predetermined revolutional speed so as to work from one side of said continuous-form sheeting to another in a longitudinal direction, perpendicular to said width direction, in accordance with said predetermined intervals of time.

49. A sheet folding mechanism for an imaging device which employs and discharges continuous-form sheeting having a plurality of transverse perforations at predetermined intervals of length along a longitudinal direction of said continuous-form sheeting, said mechanism comprising an oscillating member, arranged so as to apply a short duration impact force to said continuous-form sheeting for oscillating said continuous-form sheeting, while said continuous-form sheeting is in an unfolded state, discharged from said imaging device, whereby the oscillation caused by said oscillating member propagates a portion of said sheeting forwardly toward an outlet side of said imaging device and said continuous-form sheeting is alternately folded at said transverse perforations in opposite directions and stacked in a vertical direction between two folding positions as said continuous-form sheeting is discharged from said imaging device, said oscillating member rotating 360 degrees in one direction.

50. A sheet folding mechanism for an imaging device which employs and discharges continuous-form sheeting having a plurality of transverse perforations at predetermined intervals of length along a longitudinal direction of said continuous-form sheeting, said mechanism comprising an oscillating member, arranged so as to apply a short duration impact force to said continuous-form sheeting for oscillating said continuous-form sheeting, while said continuous-form sheeting is in an unfolded state, discharged from said imaging device, whereby the oscillation caused by said oscillating member propagates a portion of said sheeting forwardly toward an outlet side of said imaging device and said continuous-form sheeting is alternately folded at said transverse perforations in opposite directions and stacked in a vertical direction between two folding positions as said continuous-form sheeting is discharged from said imaging device, said oscillating member having a dimension, in a direction transverse to the movement of the continuous form sheeting, substantially less than the dimension of the continuous-form sheeting in the transverse direction.

51. An imaging system comprising:

an imaging device having means for discharging continuous-form sheeting and means for forming an image on said continuous-form sheeting by a heat-pressing operation, said continuous-form sheeting having a plurality of transverse perforations at predetermined intervals of length along a longitudinal direction of said continuous-form sheeting; and a sheet folding mechanism comprising means for flicking said continuous-form sheeting, while said continuous-form sheeting is in an unfolded state, at predetermined intervals of time after said continuous-form sheeting is discharged from said imaging device, thereby causing a disturbance in said continuous-form sheeting and initiating folding at said plurality of perforations.

* * * * *

UNITED STATES PATENT AND TRADEMARK OFFICE

CERTIFICATE OF CORRECTION

PATENT NO. : 5,242,366

DATED : September 7, 1993

INVENTOR(S) : M. KITA

It is certified that error appears in the above-indentified patent and that said Letters Patent is hereby corrected as shown below:

At column 6, line 25 (claim 10, line 2), change "comprises," to ---comprises a --.

At column 6, lines 26 and 27 (claim 10, lines 3 and 4), delete "contacted with".

At column 8, line 6 (claim 29, line 4), change "pole" to ---plate---.

At column 8, line 48 (claim 33, line 2), after "portion," insert ---extending---.

At column 9, line 35 (claim 40, line 4), before "folding positions" insert ---two---.

Signed and Sealed this

Tenth Day of December, 1996

Bruce Lehman

*Attest:*

BRUCE LEHMAN

*Attesting Officer*

*Commissioner of Patents and Trademarks*